US010492968B2

(12) United States Patent
Elku et al.

(10) Patent No.: US 10,492,968 B2
(45) Date of Patent: Dec. 3, 2019

(54) PATIENT SUPPORT APPARATUS WITH ADJUSTABLE FOOT SECTION

(71) Applicant: Stryker Corporation, Kalamazoo, MI (US)

(72) Inventors: Joseph Steven David Elku, Tillsonburg (CA); Jason John Connell, London (CA); Richard A. Derenne, Portage, MI (US); Jason James Cerny, London (CA)

(73) Assignee: Stryker Corporation, Kalamazoo, MI (US)

( * ) Notice: Subject to any disclaimer, the term of this patent is extended or adjusted under 35 U.S.C. 154(b) by 250 days.

(21) Appl. No.: 15/473,716

(22) Filed: Mar. 30, 2017

(65) Prior Publication Data

US 2017/0281438 A1 Oct. 5, 2017

Related U.S. Application Data

(60) Provisional application No. 62/316,141, filed on Mar. 31, 2016.

(51) Int. Cl.
*A61G 7/00* (2006.01)
*A61G 7/015* (2006.01)
(Continued)

(52) U.S. Cl.
CPC ..... *A61G 7/015* (2013.01); *A61G 1/02* (2013.01); *A61G 7/012* (2013.01); *A61G 7/018* (2013.01);
(Continued)

(58) Field of Classification Search
CPC ..... A61G 7/00; A61G 7/015
(Continued)

(56) References Cited

U.S. PATENT DOCUMENTS 3,051,965 A * 9/1962 Szemplak ..... A47C 20/041 297/344.17
3,530,514 A 9/1970 McCalley
(Continued)

FOREIGN PATENT DOCUMENTS

EP 364394 A2 4/1990
TR 201408650 1/2015
(Continued)

OTHER PUBLICATIONS

English language abstract and machine-assisted translation for EP0364394 extracted from espacenet.com on Oct. 18, 2017; 8 pages.

(Continued)

*Primary Examiner* — Fredrick C Conley
(74) *Attorney, Agent, or Firm* — Howard & Howard Attorneys PLLC

(57) ABSTRACT

A patient support apparatus comprises a base, a support frame, and a patient support deck. The patient support deck comprises articulating deck sections, such as a leg section and a foot section pivotally coupled to the leg section. A support link is arranged to support the foot section relative to the support frame. A leg section actuator is configured to move the leg section between a lowered position and one or more raised positions. A foot section adjustment device is configured to move the support link in order to move the foot section relative to the leg section. The support link has a first link end pivotally coupled to the foot section and a second link end slidably coupled to the support frame.

23 Claims, 10 Drawing Sheets

(51) Int. Cl.

| | |
|---|---|
| ***A61G 1/02*** | (2006.01) |
| ***A61G 7/012*** | (2006.01) |
| ***A61G 7/018*** | (2006.01) |
| ***A61G 7/05*** | (2006.01) |
| ***A61G 7/075*** | (2006.01) |

(52) U.S. Cl.
CPC ..... *A61G 7/0506* (2013.01); *A61G 7/0507* (2013.01); *A61G 7/0755* (2013.01); *A61G 2203/32* (2013.01)

(58) Field of Classification Search
USPC ..... 5/713–718
See application file for complete search history.

(56) References Cited

U.S. PATENT DOCUMENTS

| | | | | |
|---|---|---|---|---|
| 5,161,274 | A | 11/1992 | Hayes et al. | |
| 6,393,641 | B1 * | 5/2002 | Hensley ..... | A47C 20/041 5/613 |
| 6,839,926 | B2 | 1/2005 | Heimbrock et al. | |
| 7,171,708 | B2 | 2/2007 | Osborne et al. | |
| 7,296,312 | B2 | 11/2007 | Menkedick et al. | |
| 7,441,291 | B2 | 10/2008 | Hayes et al. | |
| 7,454,805 | B2 | 11/2008 | Osborne et al. | |
| 7,533,429 | B2 | 5/2009 | Menkedick et al. | |
| 7,610,637 | B2 | 11/2009 | Menkedick et al. | |
| 7,703,158 | B2 | 4/2010 | Wilker, Jr. et al. | |
| 7,926,131 | B2 | 4/2011 | Menkedick et al. | |
| RE43,193 | E | 2/2012 | Osborne et al. | |
| 8,151,387 | B2 | 4/2012 | Osborne et al. | |
| 2002/0178502 | A1 | 12/2002 | Beasley et al. | |
| 2014/0325759 | A1 | 11/2014 | Bly et al. | |
| 2018/0214326 | A1 | 8/2018 | Lacasse et al. | |

FOREIGN PATENT DOCUMENTS

| | | | |
|---|---|---|---|
| WO | 1996029970 | A1 | 10/1996 |
| WO | 2014191684 | A1 | 12/2014 |
| WO | WO 2014/191684 | | 12/2014 |
| WO | 2015032003 | A1 | 3/2015 |

OTHER PUBLICATIONS

TR 2014-08650, The relevancy of this Turkish design patent as presently understood is found in the figures/photos of this document downloaded from the Turkish Patent Office on Sep. 26, 2018.
English language abstract and machine-assisted English translation for WO 2014/191684 extracted from espacenet.com database on Sep. 26, 2018, 14 pages.

* cited by examiner

PATIENT SUPPORT APPARATUS WITH ADJUSTABLE FOOT SECTION

RELATED APPLICATIONS

This application claims priority to and the benefit of U.S. Provisional Patent Application No. 62/316,141, filed on Mar. 31, 2016, the entire contents of which are hereby incorporated by reference herein.

BACKGROUND

Patient support apparatuses, such as hospital beds, stretchers, cots, tables, and wheelchairs, facilitate care of patients in a health care setting. Conventional patient support apparatuses comprise a base, a support frame, and a patient support deck upon which the patient is supported. The patient support deck usually comprises several deck sections capable of articulating relative to one another, such as a back section, a seat section, a leg section, and a foot section. These deck sections can be positioned in several different configurations, including vascular configurations that prevent adverse health or circulatory issues associated with compromised blood flow. In such vascular configurations, the leg and foot sections are controlled so that legs of a patient are kept elevated and above a level of the patient's sternum.

Often, one end of the foot section is pivotally coupled to the leg section to be raised when the leg section is raised. An opposite free end of the foot section is then separately supported by a stay, support arm, bolster, or other type of support link that extends between the support frame and the foot section. These support links are manually adjusted by users to raise or lower the free end of the foot section relative to the leg section to place the leg and foot sections in a vascular configuration. Owing to the support links being manual adjusted, considerable effort may be needed to raise the free end of the foot section, especially in cases of heavier patients. In other patient support apparatuses, a linear actuator may be used to raise or lower the free end of the foot section relative to the leg section. However, the linear actuator typically extends from the support frame to the foot section, which may take up considerable space on the support frame.

A patient support apparatus with an adjustable foot section designed to overcome one or more of the aforementioned disadvantages is desired.

DETAILED DESCRIPTION

Figure 1:
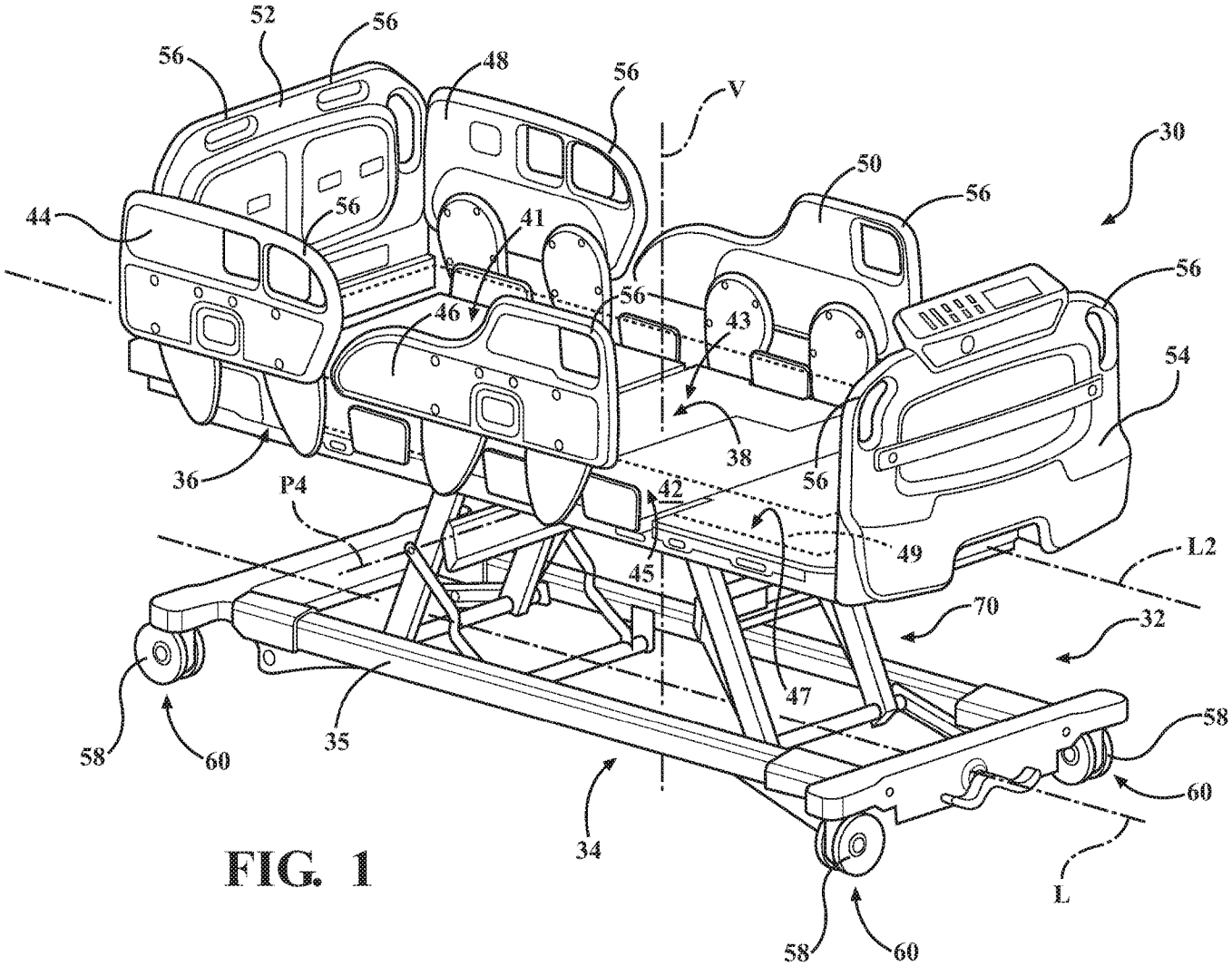
FIG. 1 is a perspective view of a patient support apparatus.

Referring to FIG. 1, a patient support apparatus 30 is shown for supporting a patient in a health care setting. The patient support apparatus 30 illustrated in FIG. 1 comprises a hospital bed. In other embodiments, however, the patient support apparatus 30 may comprise a stretcher, cot, table, wheelchair, or similar apparatus utilized in the care of a patient.

A support structure 32 provides support for the patient. The support structure 32 illustrated in FIG. 1 comprises a base 34 and a support frame 36. The base 34 comprises a base frame 35. The support frame 36 is spaced above the base frame 35 in FIG. 1. The support structure 32 also comprises a patient support deck 38 disposed on the support frame 36. The patient support deck 38 comprises several sections, some of which are pivotable relative to the support frame 36, such as a back section 41, a seat section 43, a leg section 45, and a foot section 47. The patient support deck 38 provides a patient support surface 42 upon which the patient is supported.

A mattress 49 (shown in hidden lines in FIG. 1) is disposed on the patient support deck 38 during use. The mattress 49 comprises a secondary patient support surface upon which the patient is supported. The base 34, support frame 36, patient support deck 38, and patient support surfaces 42 each have a head end and a foot end corresponding to designated placement of the patient's head and feet on the patient support apparatus 30. The base 34 comprises a longitudinal axis L along its length from the head end to the foot end. The base 34 also comprises a vertical axis V arranged crosswise (e.g., perpendicularly) to the longitudinal axis L along which the support frame 36 is lifted and lowered relative to the base 34. The support frame 36 comprises a second longitudinal axis L2 along its length from the head end to the foot end. The construction of the support structure 32 may take on any known or conventional design, and is not limited to that specifically set forth above. In addition, the mattress 49 may be omitted in certain embodiments, such that the patient rests directly on the patient support surface 42.

Side rails 44, 46, 48, 50 are coupled to the support frame 36 and thereby supported by the base 34. A first side rail 44 is positioned at a right head end of the support frame 36. A second side rail 46 is positioned at a right foot end of the support frame 36. A third side rail 48 is positioned at a left head end of the support frame 36. A fourth side rail 50 is positioned at a left foot end of the support frame 36. If the patient support apparatus 30 is a stretcher or a cot, there may be fewer side rails. The side rails 44, 46, 48, 50 are movable between a raised position in which they block ingress and egress into and out of the patient support apparatus 30, one or more intermediate positions, and a lowered position in which they are not an obstacle to such ingress and egress. In still other configurations, the patient support apparatus 30 may not include any side rails.

A headboard 52 and a footboard 54 are coupled to the support frame 36. In other embodiments, when the headboard 52 and footboard 54 are included, the headboard 52 and footboard 54 may be coupled to other locations on the patient support apparatus 30, such as the base 34. In still other embodiments, the patient support apparatus 30 does not include the headboard 52 and/or the footboard 54.

Caregiver interfaces 56, such as handles, are shown integrated into the footboard 54 and side rails 44, 46, 48, 50 to facilitate movement of the patient support apparatus 30 over floor surfaces. Additional caregiver interfaces 56 may be integrated into the headboard 52 and/or other components of the patient support apparatus 30. The caregiver interfaces 56 are graspable by the caregiver to manipulate the patient support apparatus 30 for movement.

Other forms of the caregiver interface 56 are also contemplated. The caregiver interface 56 may comprise one or more handles coupled to the support frame 36. The caregiver interface 56 may simply be a surface on the patient support apparatus 30 upon which the caregiver logically applies force to cause movement of the patient support apparatus 30 in one or more directions, also referred to as a push location. This may comprise one or more surfaces on the support frame 36 or base 34. This could also comprise one or more surfaces on or adjacent to the headboard 52, footboard 54, and/or side rails 44, 46, 48, 50. In other embodiments, the caregiver interface may comprise separate handles for each hand of the caregiver. For example, the caregiver interface may comprise two handles.

Wheels 58 are coupled to the base 34 to facilitate transport over the floor surfaces. The wheels 58 are arranged in each of four quadrants of the base 34 adjacent to corners of the base 34. In the embodiment shown, the wheels 58 are caster wheels able to rotate and swivel relative to the support structure 32 during transport. Each of the wheels 58 forms part of a caster assembly 60. Each caster assembly 60 is mounted to the base 34. It should be understood that various configurations of the caster assemblies 60 are contemplated. In addition, in some embodiments, the wheels 58 are not caster wheels and may be non-steerable, steerable, non-powered, powered, or combinations thereof. Additional wheels are also contemplated. For example, the patient support apparatus 30 may comprise four non-powered, non-steerable wheels, along with one or more powered wheels. In some cases, the patient support apparatus 30 may not include any wheels.

In other embodiments, one or more auxiliary wheels (powered or non-powered), which are movable between stowed positions and deployed positions, may be coupled to the support structure 32. In some cases, when these auxiliary wheels are located between caster assemblies 60 and contact the floor surface in the deployed position, they cause two of the caster assemblies 60 to be lifted off the floor surface thereby shortening a wheel base of the patient support apparatus 30. A fifth wheel may also be arranged substantially in a center of the base 34.

Figure 2:
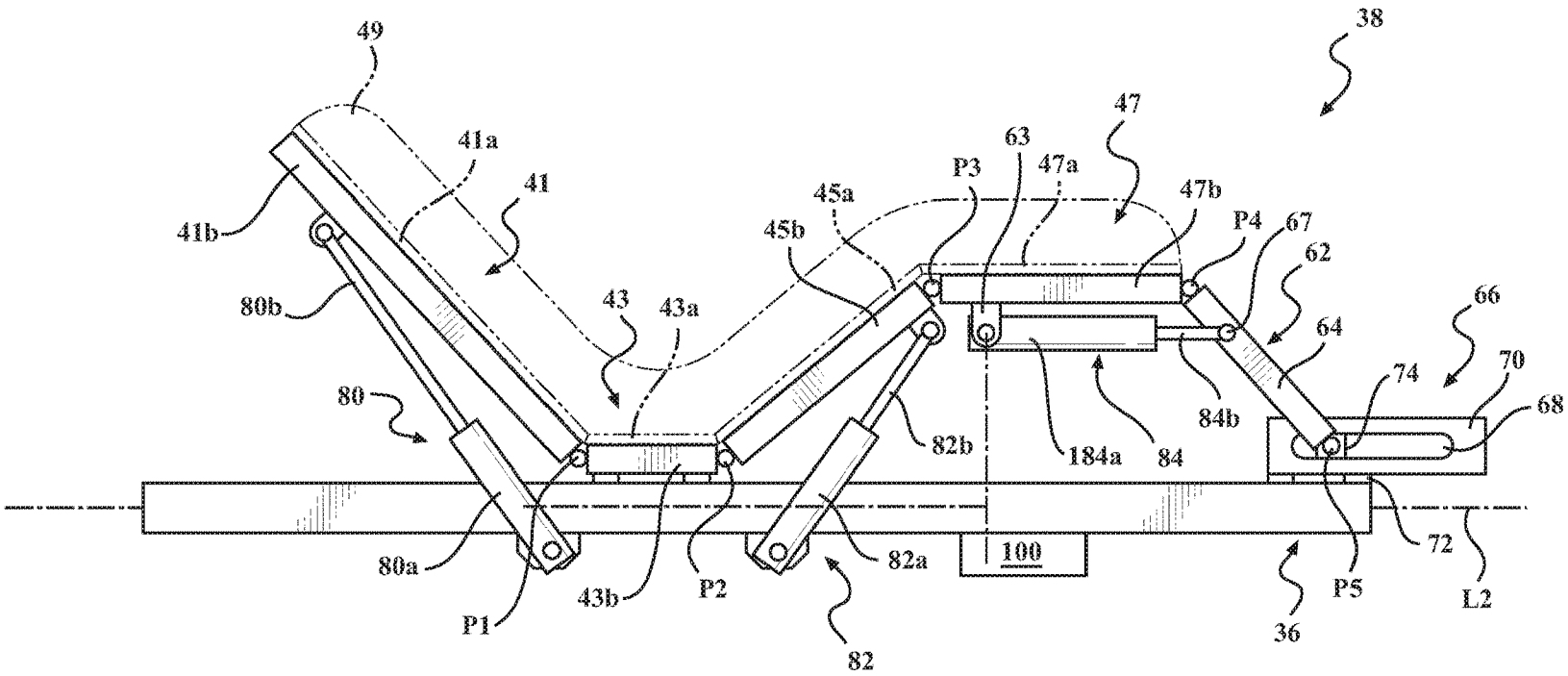
FIG. 2 is an illustration of a support frame and patient support deck of the patient support apparatus.

Referring to FIG. 2, an illustration of the patient support deck 38 is shown supported by the support frame 36. In particular, the deck sections 41, 43, 45, 47 are shown in a configuration in which the back section 41 is raised above the support frame 36, the seat section 43 is fixed to the support frame 36 (such as by welding, fasteners, or the like), the leg section 45 is raised above the support frame 36, and the foot section 47 is elevated above the support frame 36 in a plane parallel to the second longitudinal axis L2.

The deck sections 41, 43, 45, 47 are pivotally coupled together in series at pivot joints defined about pivot axes P1, P2, P3. Each of the deck sections 41, 43, 45, 47 have a first end and a second end. The first end is closer to the head end of the patient support apparatus 30 when the patient support deck 38 is in a flat configuration and the second end is closer to the foot end of the patient support apparatus 30 when the patient support deck 38 is in the flat configuration. In the embodiment shown, the second end of the back section 41 is pivotally coupled to the first end of the seat section 43 about pivot axis P1. The first end of the leg section 45 is pivotally coupled to the second end of the seat section 43 about pivot axis P2. The first end of the foot section 47 is pivotally coupled to the second end of the leg section 45 about pivot axis P3.

The deck sections 41, 43, 45, 47 may be pivotally coupled together by pivot pins, shafts, and the like at the pivot joints. Pivot brackets may be employed to form the pivot joints. Additionally, other types of connections are possible between the deck sections 41, 43, 45, 47 so that the deck sections 41, 43, 45, 47 are capable of moving, e.g., articulating, relative to one another. For instance, in some cases, translational joints may be provided between adjacent deck sections, or other compound movement connections may be provided between adjacent deck sections, such as joints that allow both pivotal and translational motion between adjacent deck sections. Further, in other cases, the back section 41 and the leg section 45 may be pivotally (or otherwise) connected directly to the support frame 36 or other part of the support structure 32, instead of the seat section 43.

Figure 3:
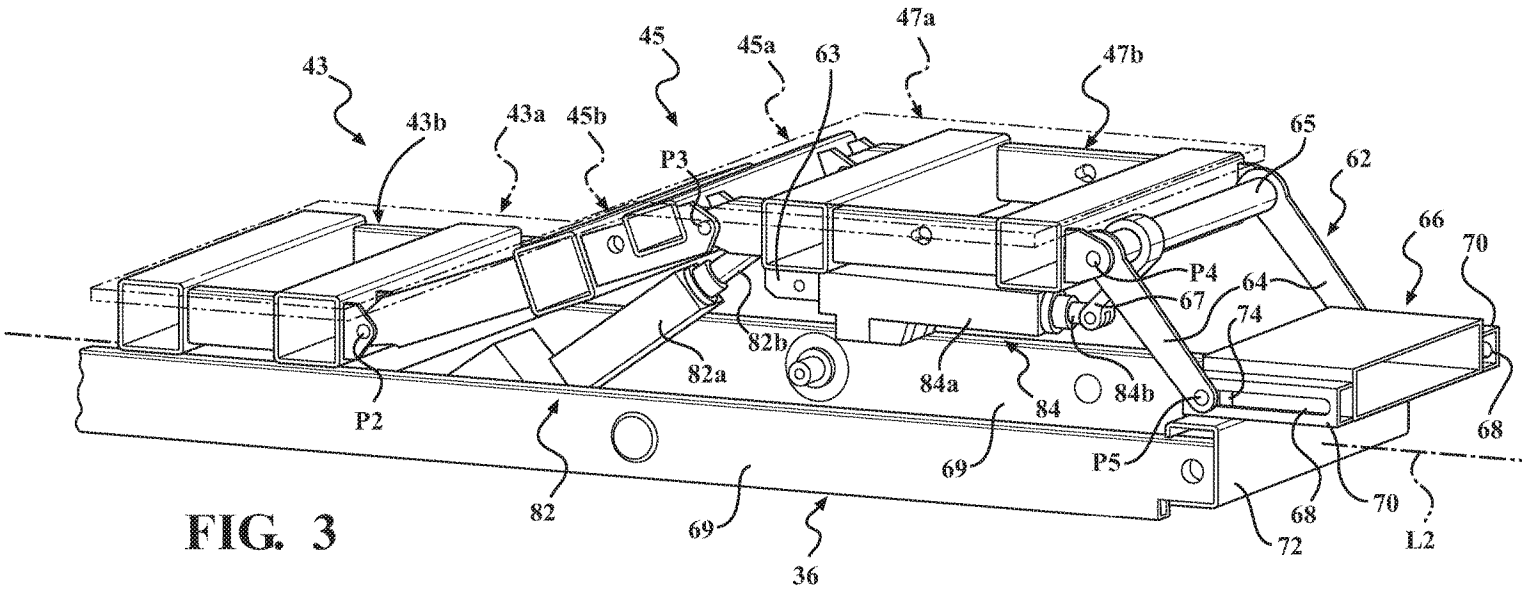
FIG. 3 is a top perspective view of a portion of the support frame and the patient support deck illustrating seat, leg, and foot sections in a vascular configuration.

As shown by hidden lines, the deck sections 41, 43, 45, 47 comprise deck panels 41*a*, 43*a*, 45*a*, 47*a*, removably coupled to deck section frames 41*b*, 43*b*, 45*b*, 47*b* (see also FIG. 3). It should be appreciated that, in other embodiments, the deck sections 41, 43, 45, 47 may comprise only the deck section frames 41*b*, 43*b*, 45*b*, 47*b* or only the deck panels 41*a*, 43*a*, 45*a*, 47*a*. The deck panels 41*a*, 43*a*, 45*a*, 47*a* may be plastic panels that snap fit or are otherwise capable of being easily removed from the deck section frames 41*b*, 43*b*, 45*b*, 47*b* for cleaning, etc. The deck panels 41*a*, 43, 45*a*, 47*a*, could also be formed of other materials and may be permanently affixed to the deck sections frames 41*b*, 43*b*, 45*b*, 47*b*. Each of the deck section frames 41*b*, 43*b*, 45*b*, 47*b* may be formed of metal and comprise structural members (e.g., metal bars and tubes) welded together to form a support framework. The deck sections frames 41*b*, 43*b*, 45*b*, 47*b* could also be formed of other materials and comprise only single members, such as a single panel, frame, or other type of support structure.

Referring to FIGS. 2 and 3, a support link 62 extends between the support frame 36 and the foot section 47 to support the foot section 47. The support link 62 is arranged to support the second end of the foot section 47 with respect to the support frame 36. The support link 62 has a first link end pivotally coupled to the second end of the foot section 47. The support link 62 extends from the first link end to a second link end pivotally and slidably coupled to the support frame 36. In the embodiment shown, the support link 62 comprises a pair of spaced apart support arms 64. In other embodiments, the support link 62 may comprise only a single support arm, or other type of support member (or members) that support the second end of the foot section 47 with respect to the support frame 36.

The support arms 64 are pivotally coupled at the first link end to the foot section 47 about pivot axis P4. The support arms 64 may be pivotally coupled to the foot section 47 via pivot pins, shafts, or the like. In the embodiment shown, the support arms 64 are fixed to opposing ends of a cross shaft 65 (see FIG. 3). The cross shaft 65 is pivotally coupled to the foot section 47 via pivot pins. Additionally, other types of connections may be provided between the support link 62 and the foot section 47 so long as the support link 62 is able to move relative to the foot section 47. The support arms 64 are pivotally and slidably coupled to the support frame 36 at the second link end.

The support frame 36 comprises a guide 66 that supports the second link end of the support link 62. In particular, the second link end of the support link 62 is pivotally and slidably coupled to the guide 66. Thus, the guide 66 is arranged to guide sliding movement of the second link end of the support link 62. The guide 66 comprises a pair of guide tracks 70 that are fixed to a cross frame member 72 of the support frame 36. In the embodiment shown, the guide tracks 70 are shown being formed of rectangular metal tubing. In other embodiments, the guide tracks 70 may be formed of other materials and may assume other forms or shapes capable of guiding movement of the support arms 64. In further embodiments, the guide tracks 70 may be integral parts of longitudinal frame members 69 of the support frame 36. In still further embodiments, a single guide track 70 may be provided. The shape of the guide tracks 70 dictate the path along which the second link end of the support link 62 follows during movement of the support link 62.

In the embodiment shown in FIGS. 2 and 3, the guide tracks 70 are oriented parallel to the second longitudinal axis L2 of the support frame 36. In other embodiments, like that shown in FIG. 3A, the guide tracks 70 are obliquely oriented relative to the second longitudinal axis L2 of the support frame 36. More specifically, the guide tracks 70 may be oriented at an acute angle $\alpha$ to the second longitudinal axis L2 of more than 0 degrees and less than 90 degrees, from 1 degree to 89 degrees, from 5 degrees to 85 degrees, from 10 degrees to 80 degrees, from 20 degrees to 70 degrees, from 30 degrees to 60 degrees, from 40 degrees to 50 degrees, or between 0 degrees and 90 degrees. It should be appreciated that the guide tracks 70 may be oriented to incline upwardly toward the head end (as shown in FIG. 3A) or the guide tracks 70 may be oriented to incline upwardly toward the foot end (not shown). In either case, the acute angle $\alpha$ could be measured as shown in FIG. 3A, i.e., in the direction of the incline upwardly.

Guided bodies 74 are pivotally mounted to the support arms 64 about pivot axis P5 at the second link end. The guided bodies 74 are captured in the guide tracks 70 for sliding in the guide tracks 70. The guided bodies 74 are pivotally mounted to the support arms 64 via pivot pins, shafts, or the like. In the embodiment shown, pivot pins pivotally connect the support arms 64 to the guided bodies 74 through slots 68. The slots 68 are formed in one side of the guide tracks 70 and terminate at opposed ends of the guide tracks 70. The slots 68 have a shape that is at least one of linear or arcuate, or combinations thereof. The slots 68 may also comprise stepped slots, or slots of other shapes/configurations.

Figure 3B:
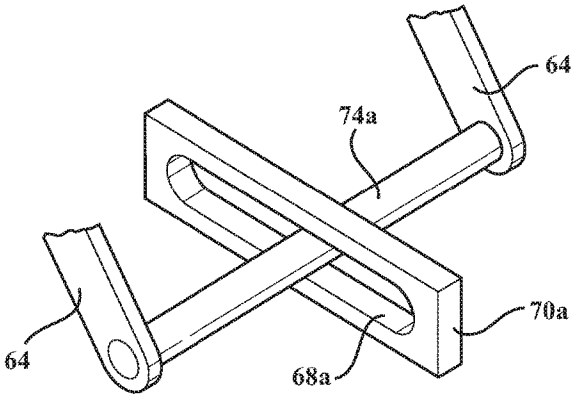
FIG. 3B is an illustration of another alternative guide and guided body.
Figure 3A:
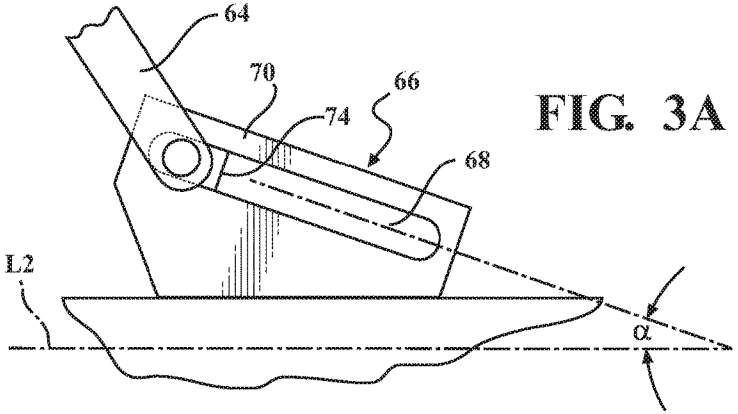
FIG. 3A is an illustration of an alternative guide.

In other embodiments, such as that show in FIG. 3B, instead of a pair of guided bodies 74 (one for each of the support arms 64), a single guided body 74*a* may be provided, such as a guided rod that extends between and interconnects the support arms 64 at the second link end. The single guided rod may be configured to slide and/or roll in a guide track 70*a* having a slot 68*a* through which the guided rod extends between the support arms 64.

When the support arms 64 are pivoted, or otherwise articulated, relative to the foot section 47, the guided bodies 74 slide in the guide tracks 70, which also simultaneously causes the guided bodies 74 to pivot relative to the support arms 64. Each of the guided bodies 74 comprise one of a block, a roller, a gear, or other movable elements. In the embodiment shown, the guide tracks 70 are slide-bearing guide tracks and the guided bodies 74 comprise blocks slidable along the slide-bearing guide tracks. The blocks can be any shape, including box-shaped, spherical, cylindrical, or the like.

Still referring to FIGS. 2 and 3, actuators 80, 82, 84 operate to move the back section 41, leg section 45, and foot section 47. The actuators 80, 82, 84 may be linear actuators, rotary actuators, or other type of actuators capable of moving the back section 41, leg section 45, and foot section 47. The actuators 80, 82, 84 may be electrically powered, hydraulic, electro-hydraulic, pneumatic, or the like. In the embodiment shown, the actuators 80, 82, 84 are electrically powered linear actuators comprising actuator housings 80*a*, 82*a*, 84*a* and drive rods 80*b*, 82*b*, 84*b* that extend and retract with respect to their associated actuator housing 80*a*, 82*a*, 84*a*. Hereinafter, the actuators 80, 82, 84 shall be referred to as back section actuator 80, leg section actuator 82, and foot section actuator 84.

The back section actuator 80 is operatively connected to the back section 41 to pivot, or otherwise articulate, the back section 41 relative to the support frame 36 between a lowered position and one or more raised positions. More specifically, the back section actuator 80 pivots the back section 41 about pivot axis P1 relative to the seat section 43. In the embodiment shown, the back section actuator 80 is pivotally connected at a first actuator end to a mounting bracket fixed to the support frame 36. The back section actuator 80 is pivotally connected at a second actuator end to a mounting bracket fixed to the back section 41. The back section actuator 80 could be pivotally connected to these brackets via pivot pins, shafts, and the like. In other embodiments, the back section actuator 80 may be connected through other types of connections or linkages in order to move the back section 41 to the lowered position or the one or more raised positions.

The leg section actuator 82 is operatively connected to the leg section 45 to pivot, or otherwise articulate, the leg section 45 relative to the support frame 36 between a lowered position and one or more raised positions. More specifically, the leg section actuator 82 pivots the leg section 45 about pivot axis P2 relative to the seat section 43. Owing to the pivotal coupling of the second end of the leg section 45 to the first end of the foot section 47, when the leg section 45 is moved, the first end of the foot section 47 is also moved. In the embodiment shown, the leg section actuator 82 is pivotally connected at a first actuator end to a mounting bracket fixed to the support frame 36. The leg section actuator 82 is pivotally connected at a second actuator end to a mounting bracket fixed to the leg section 45. The leg section actuator 82 could be pivotally connected to these brackets via pivot pins, shafts, and the like. In other embodiments, the leg section actuator 82 may be connected through other types of connections or linkages in order to move the leg section 45 to the lowered position or the one or more raised positions.

The foot section actuator 84 is operatively connected to the support link 62 to move, e.g., articulate, the support link 62 relative to the foot section 47. Movement of the support link 62 causes the foot section 47 to pivot, or otherwise articulate, relative to the leg section 45 between different foot section positions. Accordingly, the foot section actuator 84 acts as a foot section adjustment device. In the embodiment shown, the foot section actuator 84 is pivotally connected at a first actuator end to a mounting bracket 63 fixed to the foot section 47. The foot section actuator 84 is pivotally connected at a second actuator end to a mounting bracket 67 fixed to the cross shaft 65 of the support link 62. The foot section actuator 84 could be pivotally connected to these brackets 63, 67 via pivot pins, shafts, and the like. In other embodiments, the foot section actuator 84 may be connected to the foot section 47 or the support link 62 through other types of connections or linkages.

During operation, when the foot section actuator 84 moves the support link 62, the second link end of the support link 62 slides relative to the guide 66. Since movement of the second link end is constrained by the guide 66, e.g., constrained to longitudinal movement or oblique movement, sliding of the second link end away from the seat section 43 causes the second end of the foot section 47 to lower relative to its first end by pivoting about pivot axis P3 (assuming leg section 45 is stationary). Sliding of the second link end toward the seat section 43 causes the second end of the foot section 47 to be raised relative to its first end by pivoting about pivot axis P3 (assuming leg section 45 is stationary).

When the foot section actuator 84 ceases operation, and the leg section actuator 82 is operated to raise or lower the leg section 45, the second link end of the support link 62 again slides with respect to the guide 66. This action is due to the foot section 47, support link 62, and the foot section actuator 84 essentially forming a single link between the second end of the leg section 45 and the guided bodies 74 because the foot section actuator 84 holds the position of the support link 62 relative to the foot section 47 when the foot section actuator 84 ceases operation.

The actuators 80, 82, 84 are operable to move the patient support deck 38 to different configurations. FIGS. 4A-4D show various positions of the seat section 43, leg section 45, and foot section 47 in a few different configurations (back section 41 removed for clarity in these Figures). It should be appreciated that numerous configurations of the deck sections 41, 43, 45, 47 are possible and those shown only represent a small subset of possible configurations.

Figure 4A:
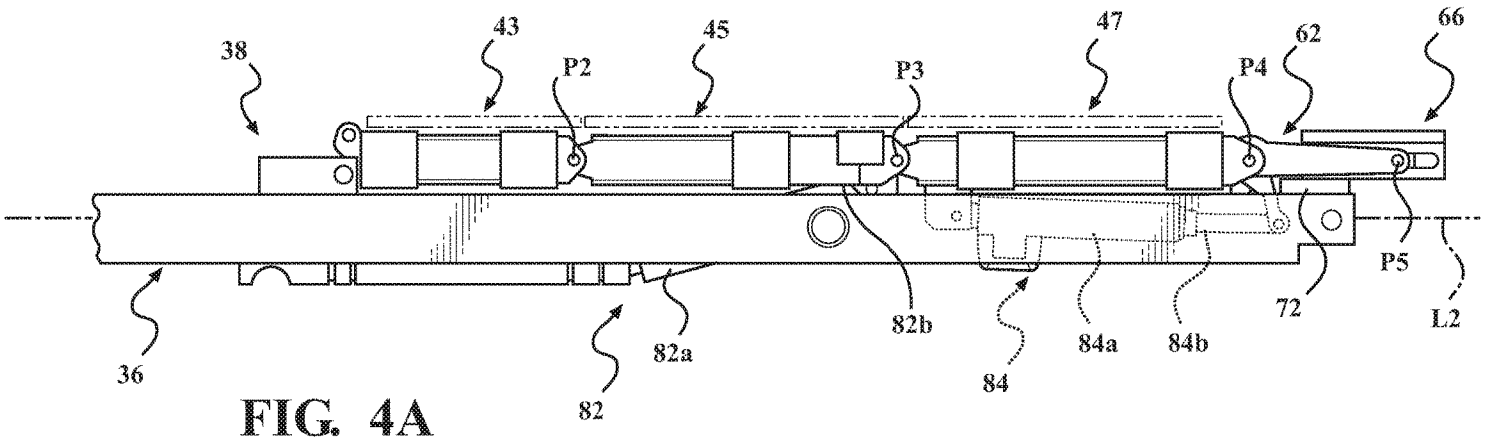
FIGS. 4A-4D are elevational views of the support frame and the patient support deck in various configurations illustrating powered actuation of a foot section.

FIG. 4A shows the seat section 43, leg section 45, and foot section 47 in a flat configuration in which a patient would lie flat on the patient support deck 38. In this configuration, the seat section 43, leg section 45, and foot section 47 are aligned parallel to the second longitudinal axis L2. The support link 62 is also aligned with the seat section 43, leg section 45, and foot section 47 to be flat and parallel to the second longitudinal axis L2. In this configuration, the drive rod 82*b* of the leg section actuator 82 has been fully retracted into the actuator housing 82*a* and the drive rod 84*b* of the foot section actuator 84 has been fully extended from the actuator housing 84*a*.

Figure 4B:
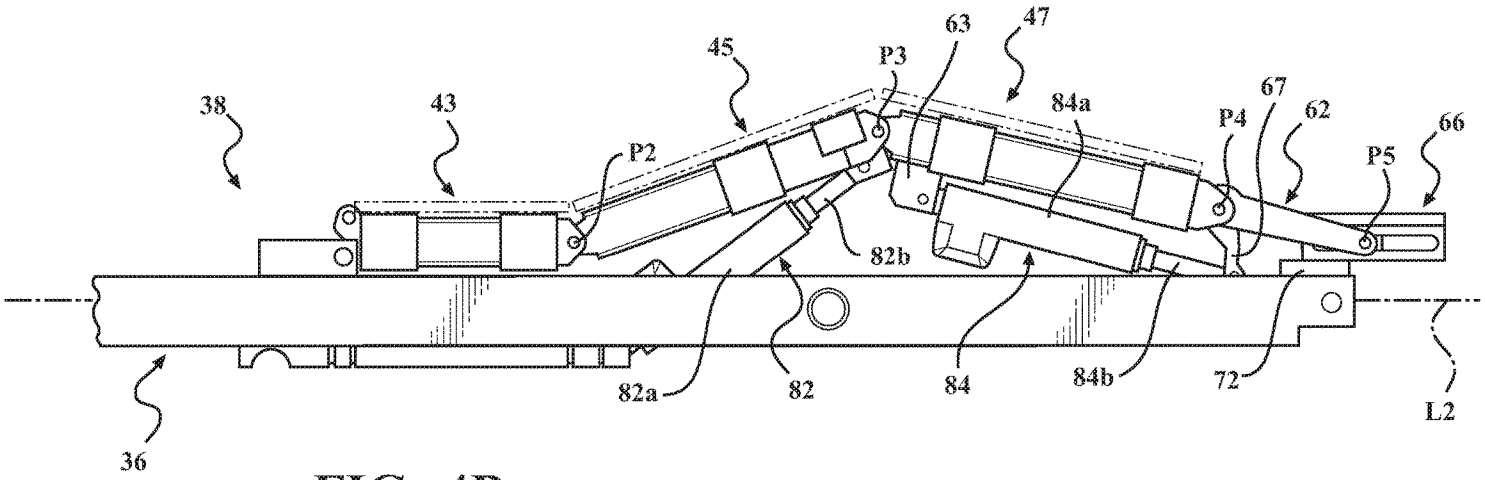

FIG. 4B shows the leg section 45 and foot section 47 in a partially raised configuration in which a patient's knee would be partially elevated (at pivot axis P3). To reach this configuration, the leg section actuator 82 has been operated to partially extend the drive rod 82*b* from the housing 82*a*, but the foot section actuator 84 remains unactuated (the support link 62 is still aligned with the foot section 47).

Figure 4C:
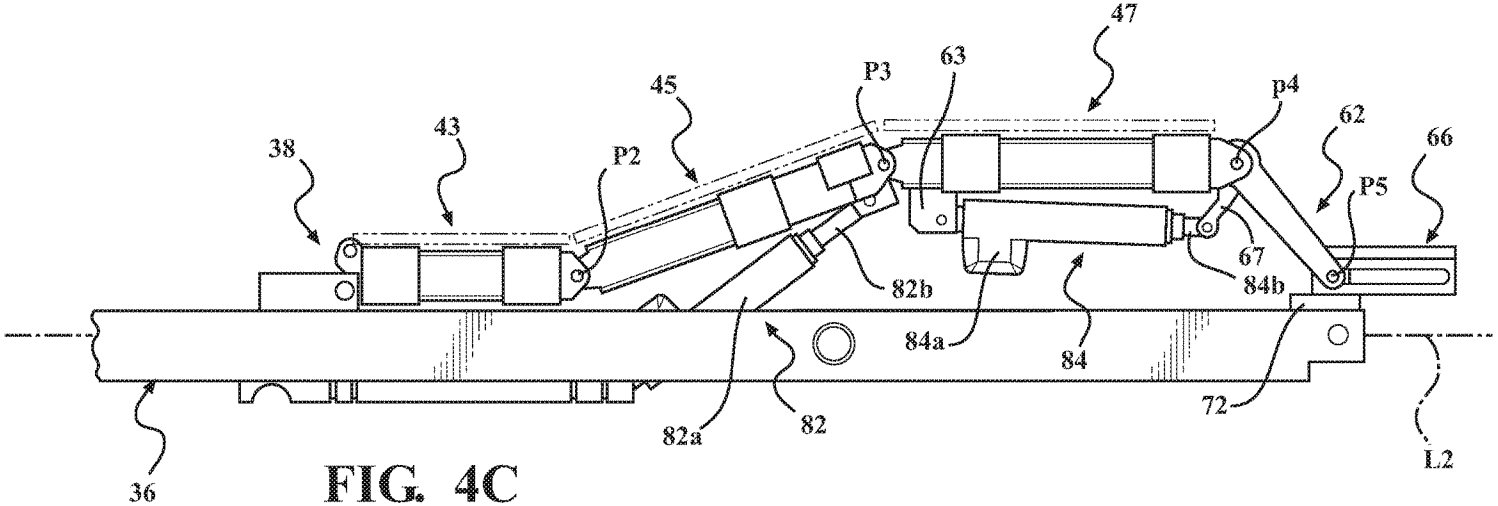

FIG. 4C shows a vascular configuration in which the leg section 45 remains raised relative to the support frame 36 to the same extent as shown in FIG. 4B, but now the second end of the foot section 47 is raised relative to the support frame 36 so that the foot section 47 is generally parallel to the second longitudinal axis L2, but in an elevated position. As illustrated by comparing FIG. 4C to FIG. 4B, in order to raise the second end of the foot section 47 and pivot the foot section 47 relative to the leg section 45 about pivot axis P3, the drive rod 84*b* of the foot section actuator 84 is retracted into the housing 84*a*.

Figure 4D:
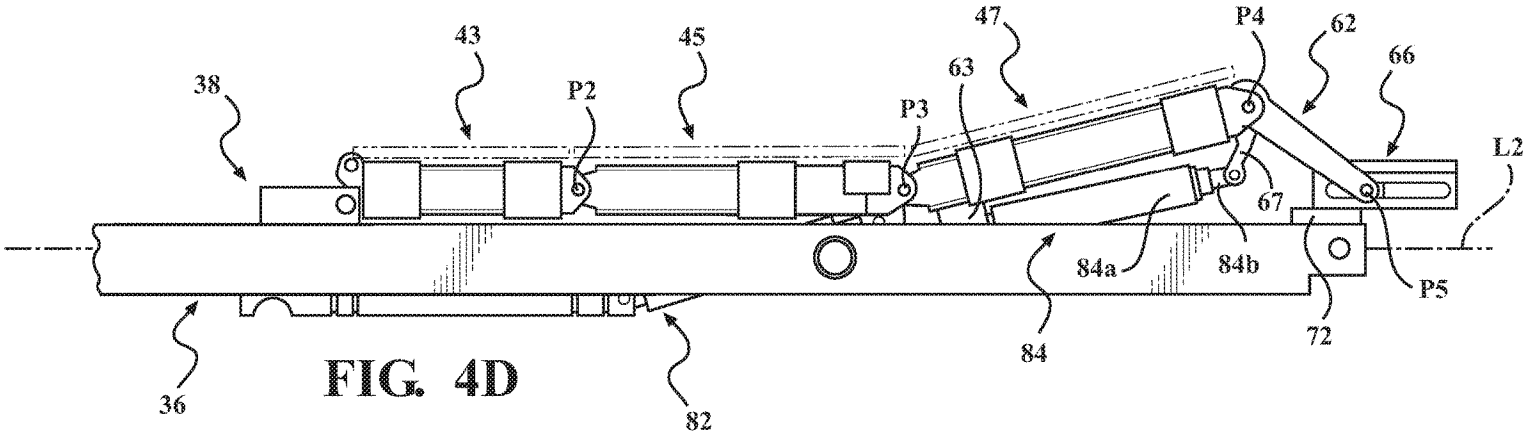
Figure 5:
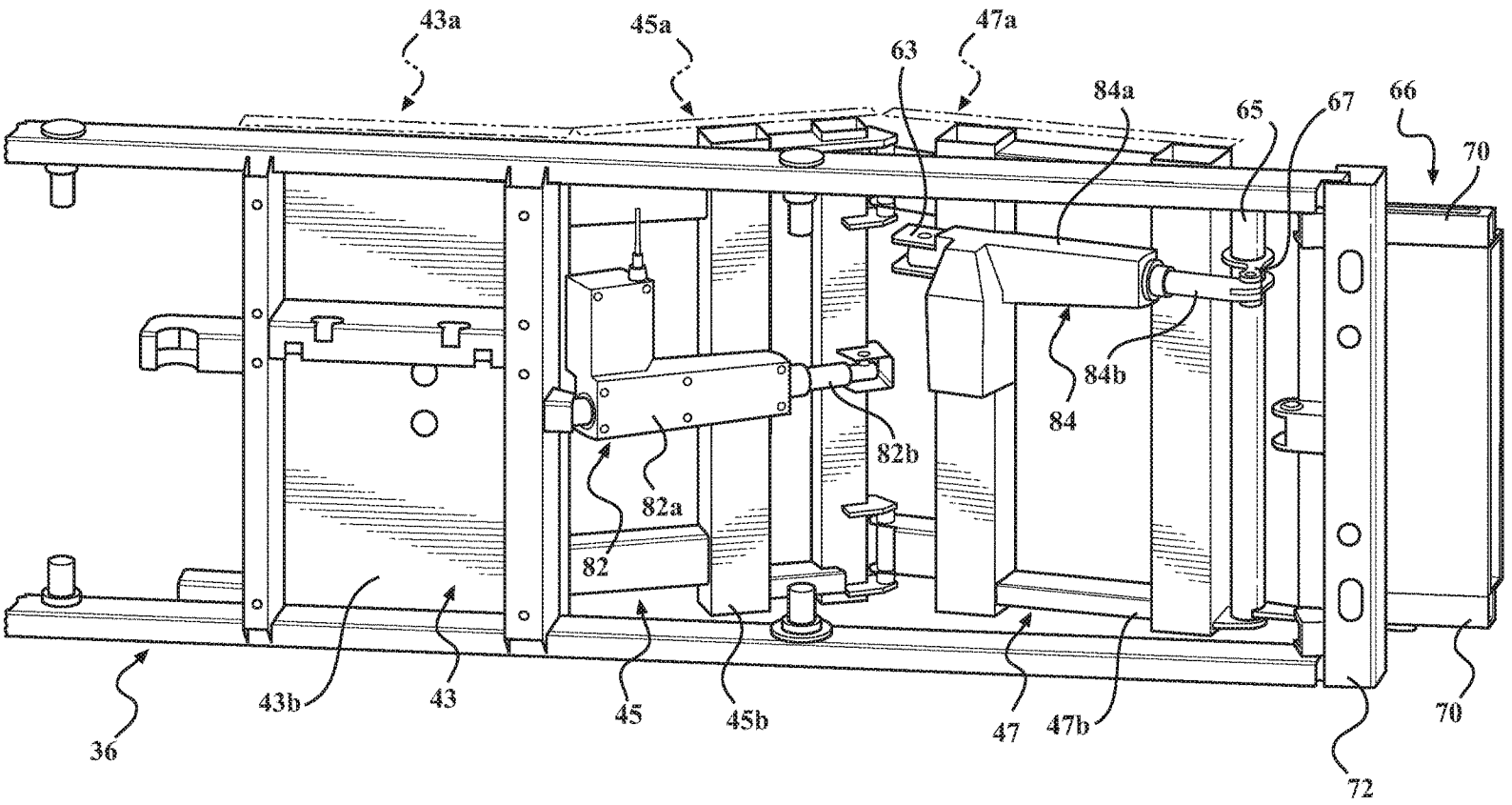
FIG. 5 is a bottom perspective view of the portion of the support frame and the patient support deck of FIG. 3.

FIG. 4D shows a configuration in which the leg section 45 is lowered from its position in the vascular configuration of FIG. 4C back to its lowered position, but the second end of the foot section 47 remains raised relative to the support frame 36. As illustrated by comparing FIG. 4D to FIG. 4C, the foot section actuator 84 remains unactuated. Thus, in order to lower the second end of the foot section 47 and place the foot section 47 back to its lowered position in the flat configuration, the foot section actuator 84 must be operated to extend the drive rod 84*b* of the foot section actuator 84 from the housing 84*a*.

A control system is provided to control operation of the actuators 80, 82, 84. The control system comprises a controller 100 (see FIG. 1) having one or more microprocessors for processing instructions or for processing an algorithm stored in memory to control operation of the actuators 80, 82, 84 and coordinate movement of the actuators 80, 82, 84 to move one or more of the deck sections 41, 43, 45, 47.

Additionally or alternatively, the controller 100 may comprise one or more microcontrollers, field programmable gate arrays, systems on a chip, discrete circuitry, and/or other suitable hardware, software, or firmware that is capable of carrying out the functions described herein. The controller 100 may be carried on-board the patient support apparatus 30, or may be remotely located. In one embodiment, the controller 100 is mounted to the base 34. In other embodiments, the controller 100 is mounted to one or more of the support frame 36, the side rails 44, 46, 48, 50, the headboard 52, the footboard 54, or any other location. Power to the actuators 80, 82, 84 and/or the controller 100 may be provided by a battery power supply or an external power source.

The controller 100 is coupled to the actuators 80, 82, 84 in a manner that allows the controller 100 to control the actuators 80, 82, 84. The controller 100 may communicate with the actuators 80, 82, 84 via wired or wireless connections to perform one of more desired functions. The controller 100 communicates with the actuators 80, 82, 84 to operate the actuators 80, 82, 84 simultaneously or sequentially to move to the patient support deck 38 to the different configurations. Thus, the deck sections 41, 43, 45, 47 may be moved to the different configurations in a coordinated manner, e.g., simultaneously, or sequentially.

The controller 100 may monitor a current state of the actuators 80, 82, 84 and determine desired states in which the actuators 80, 82, 84 should be placed, based on one or more input signals that the controller 100 receives from one or more input devices, such as position sensors. The state of the actuators 80, 82, 84 may be a position, a relative position, an angle, an energization status (e.g., on/off), or any other parameter of the actuators 80, 82, 84. Furthermore, the actuators 80, 82, 84 could be operated to reach predefined positions based on input signals received from such position sensors, e.g., the actuators 80, 82, 84 could continue operation once initiated until the predefined positions are reached as sensed by the position sensors.

The user, such as a caregiver, may actuate a user input device (not shown), which transmits a corresponding input signal to the controller 100, and the controller 100 controls operation of the actuators 80, 82, 84 based on the input signal. The user input devices may comprise any device capable of being actuated by the user. The user input devices may be configured to be actuated in a variety of different ways, including but not limited to, mechanical actuation (hand, foot, finger, etc.), hands-free actuation (voice, foot, etc.), and the like. The user input devices may comprise buttons (such as separate buttons corresponding to separately moving the back section 41, the leg section 45, or the foot section 47), a gesture sensing device for monitoring motion of hands, feet, or other body parts of the user (such as through a camera), a microphone for receiving voice activation commands, a foot pedal, and a sensor (e.g., infrared sensor such as a light bar or light beam to sense a user's body part, ultrasonic sensor, etc.). Additionally, the buttons/pedals can be physical buttons/pedals or virtually implemented buttons/pedals such as through optical projection or on a touchscreen. The buttons/pedals may also be mechanically connected or drive-by-wire type buttons/pedals where a user applied force actuates a sensor, such as a switch or potentiometer. Separate buttons or other form of input devices may also be associated with the different configurations described above, such as the vascular configuration, such that depressing one of these buttons causes actuation of all the necessary actuators 80, 82, and/or 84, either simultaneously or sequentially. It should be appreciated that any combination of user input devices may also be utilized. The user input devices may be located on one of the side rails 44, 46, 48, 50, the headboard 52, the footboard 54, or other suitable locations. The user input devices may also be located on a portable electronic device (e.g., iWatch®, iPhone®, iPad®, or similar electronic devices).

In an alternative embodiment, not shown, the support arms 64 may be extendable support arms. For instance, each of the support arms 64 may comprise separate linear actuators that are capable of extending and retracting in the same manner as the linear actuators previously described. These separate linear actuators could be controlled by the controller 100 to operate simultaneously with the foot section actuator 84 or sequentially with the foot section actuator 84 in order to move the foot section 47 between its various positions. In some cases, these separate linear actuators could replace the foot section actuator 84 in order to move the foot section 47. For instance, one end of these separate linear actuators could be pivotally coupled to the second end of the foot section 47, while an opposite end of these separate linear actuators could be pivotally coupled to the support frame 36. Further, in some cases, the opposite ends of these separate linear actuators may be unable to slide relative to the support frame 36 and thus only capable of pivoting relative to the support frame 36.

FIGS. 6A-9B illustrate an alternative foot section adjustment device. In this embodiment, instead of the powered foot section actuator 84 described above, the foot section adjustment device comprises an adjustment device that is at least partially manually operated.

Figure 6A:
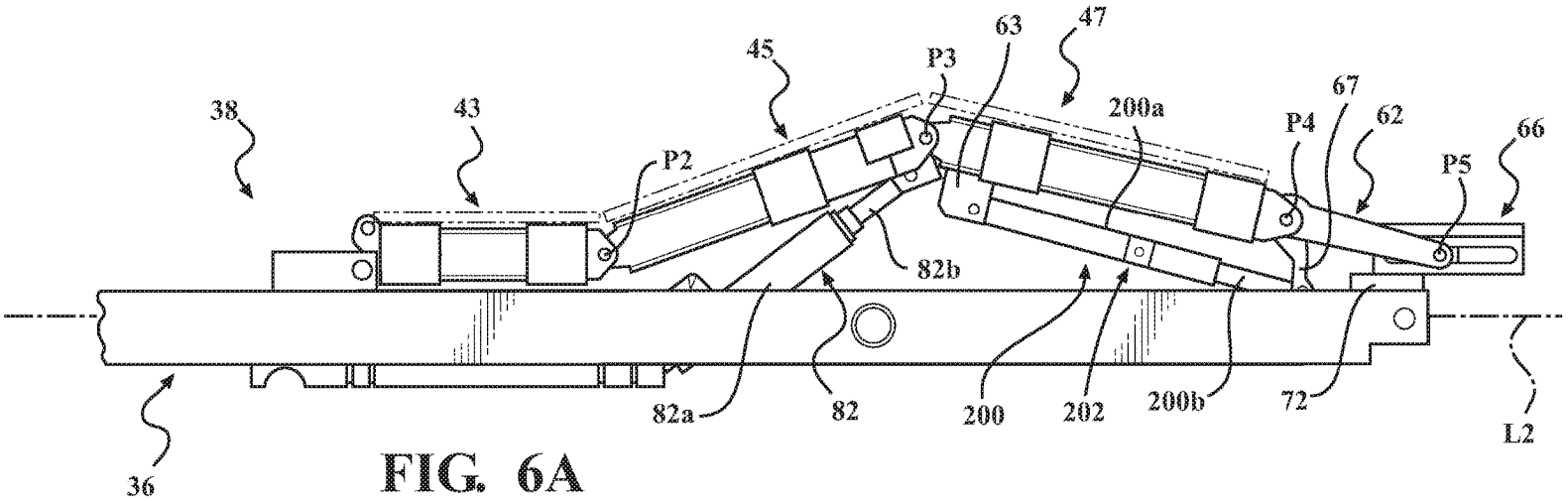
FIGS. 6A and 6B are elevational views of the support frame and the patient support deck illustrating manual actuation of the foot section.
Figure 6B:
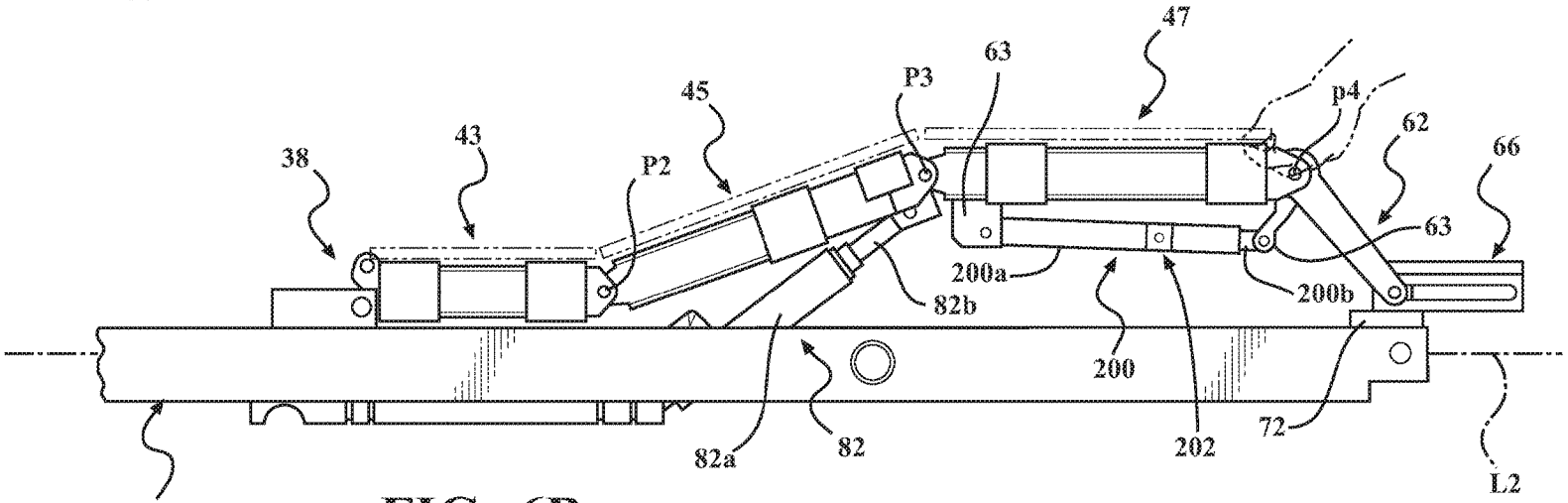
Figure 7:
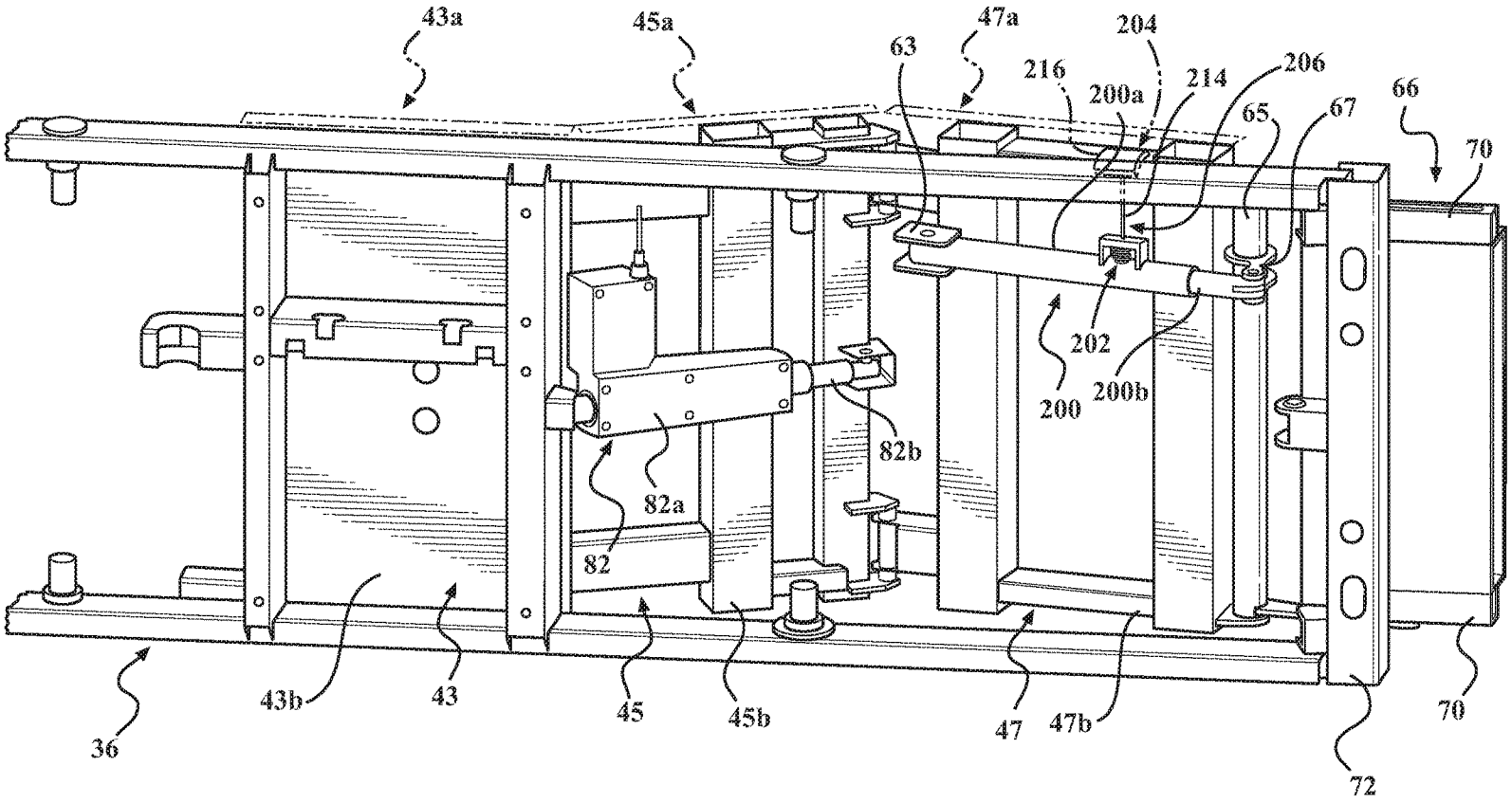
FIG. 7 is a bottom perspective view illustrating a foot section adjustment device.
Figure 8:
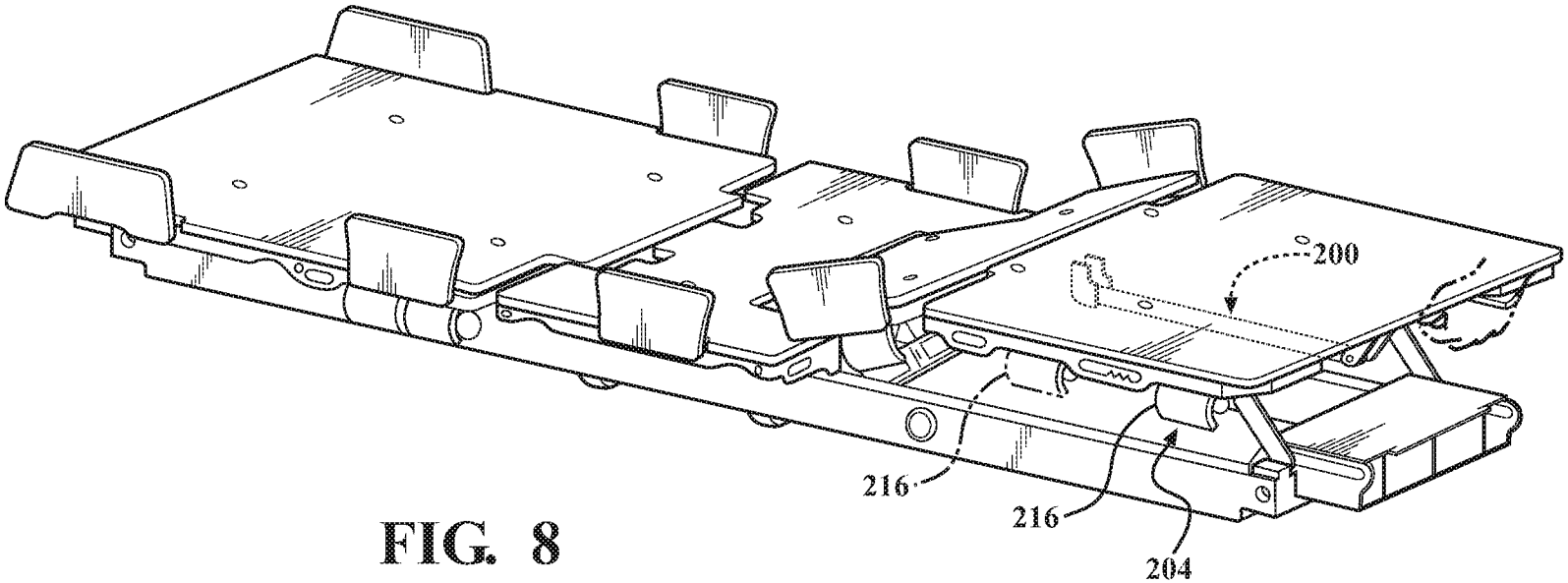
FIG. 8 is a top perspective view of the support frame and the patient support deck illustrating a manual actuation device.

Referring, for instance, to FIGS. 6A and 6B, a telescoping assembly 200 is arranged at the same location as the previously described foot section actuator 84. The telescoping assembly 200 comprises a housing 200*a* (e.g. outer tube) pivotally connected to the bracket 63 and a telescoping rod 200*b* (e.g., inner tube) pivotally connected to the bracket 67. The telescoping rod 200*b* is capable of extending and retracting relative to the housing 200*a* in the manner described further below. A locking device 202 (see also FIG. 7) is provided to lock/unlock the telescoping rod 200*b* relative to the housing 200*a* so that a user is able to extend/retract the telescoping rod 200*b* as needed, while also being able to lock the telescoping rod 200*b* at a desired position relative to the housing 200*a* so that a desired length of the telescoping assembly 200 is fixed.

In FIG. 6A, the leg section 45 and foot section 47 are in a partially raised configuration in which a patient's knee would be partially elevated (at pivot axis P3). FIG. 6B shows the vascular configuration in which the leg section 45 remains raised relative to the support frame 36 to the same extent as shown in FIG. 6A, but now the second end of the foot section 47 is raised relative to the support frame 36 so that the foot section 47 is generally parallel to the second longitudinal axis L2, but in an elevated position. In order to raise the second end of the foot section 47 and pivot the foot section 47 relative to the leg section 45 about pivot axis P3 in this embodiment, the user first operates a manual actuation device 204 (see FIG. 7) operatively connected to the locking device 202 via a release device 206. This action releases the telescoping rod 200*b* to allow telescoping movement of the telescoping rod 200*b* relative to the housing 200*a*. Thereafter, while the telescoping rod 200*b* is released, the user manual lifts the second end of the foot section 47 to the desired elevation (see also FIG. 8).

Figure 9A:
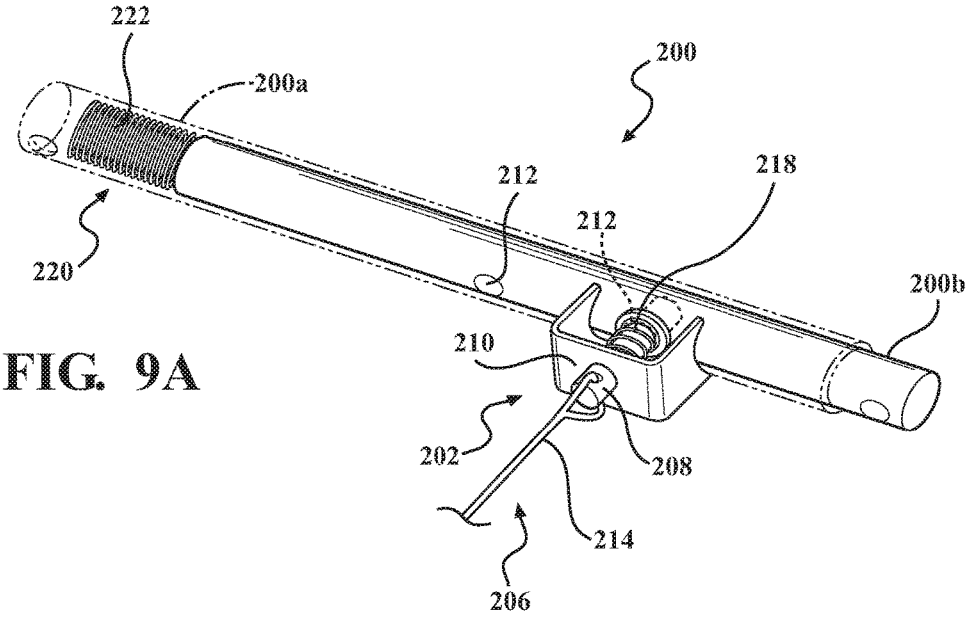
FIGS. 9A and 9B are perspective views of a telescoping assembly of the foot section adjustment device illustrating the telescoping assembly in first and second states.
Figure 9B:
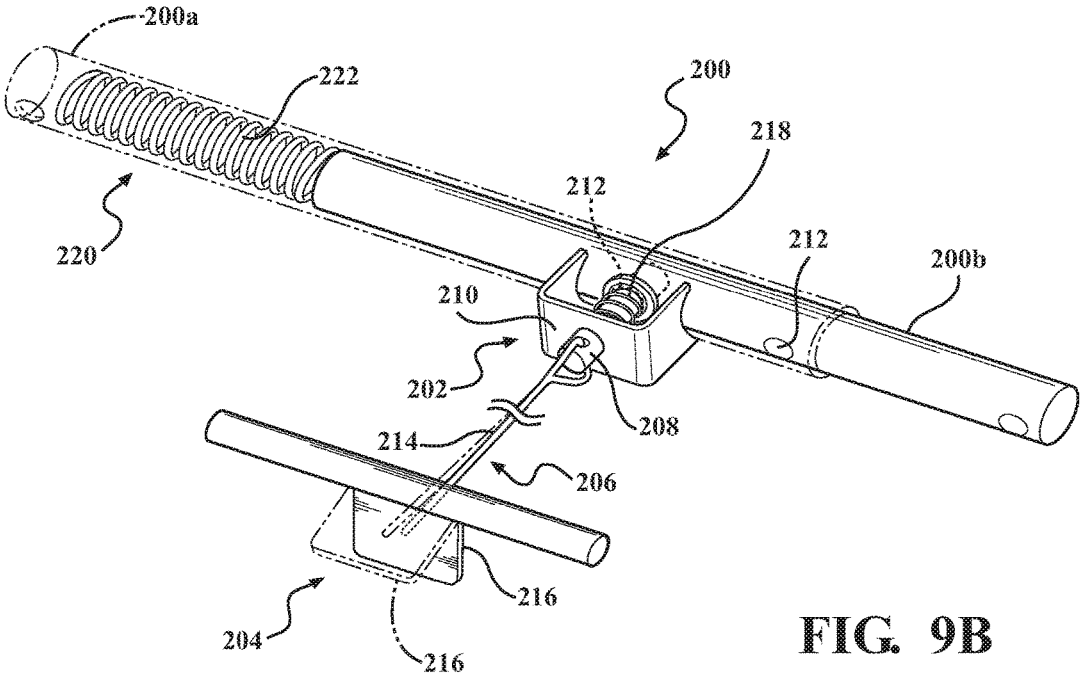

Referring to FIGS. 9A and 9B the locking device 202 is shown in more detail. The locking device 202 comprises a locking element 208. The locking element 208 is slidably supported in a mount 210 fixed to the housing 200*a*. The locking element 208 may comprise a latch pin as shown, or any other suitable type of locking element. The locking element 208 slides in an opening (not visible) defined through the housing 200*a* between a locked position and an unlocked position. In the locked position, the locking element 208 also slides into one of several adjustment holes 212 defined through the telescoping rod 200*b* when the desired adjustment hole 212 is aligned with the housing opening. The adjustment holes 212 may be spaced from one another along a length of the telescoping rod 200*b* to provide various predefined lengths of the telescoping assembly 200. Two adjustment holes 212 are shown, but any number of adjustment holes 212 may be provided. The holes shown on the opposing ends of the housing 200*a* and telescoping rod 200*b* are for purposes of pivotally connecting the telescoping assembly 200 to the brackets 63, 67, as previously described.

In the embodiment shown in FIGS. 9A and 9B, the release device 206 comprises a release member, such as cable 214. Other types of release members are also contemplated. The cable 214 may be part of a push/pull cable assembly in some embodiments. The cable 214 is mounted at one end to the locking element 208 (via cable mounting hole) and at the other end to the manual actuation device 204 (via similar cable mounting hole or other type of connection). The manual actuation device 204 comprises a lever 216 pivotally connected to the foot section 47. The cable 214 is operatively connected to the lever 216 such that manual actuation of the lever pulls on the cable 214, which in turn pulls the locking element 208 relative to the mount 210 so that the locking element 208 is withdrawn from the current adjustment hole 212 in which it was located. With the locking element 208 withdrawn and in its unlocked position, the user is able to then manually lift/lower the second end of the foot section 47 to a desired position. The user can then release the lever 216 and allow the locking element 208 to find the associated adjustment hole 212. Spring 218 biases the locking element 208 toward the adjustment holes 212 to facilitate easier engagement when the appropriate adjustment hole 212 is aligned with the opening 209. Other forms of manual actuation devices and/or release devices are also contemplated. In some cases, electronic devices may be employed to lock/unlock the locking device 202. For example, the locking element 208 may be operated via a solenoid or electric motor actuated by a manual input device, such as a switch.

Still referring to FIGS. 9A and 9B, the telescoping assembly 200 may comprise an assist device 220 that helps a user to lift the second end of the foot section 47 and/or ease lowering of the second end of the foot section 47 when being lowered by gravity, e.g., to prevent the second end of the foot section 47 from suddenly lowering, such as when a patient is present that places substantial weight on the foot section 47.

In the embodiment shown, the assist device 220 comprises a spring 222. In this embodiment, one end of the spring 222 is fixed inside the housing 200*a* and an opposed end of the spring 222 is fixed to an end of the telescoping rod 200*b*. In FIG. 9A the spring 222 is shown in its normal state with the telescoping assembly 200 in a retracted state. In FIG. 9B, the spring 222 is shown acting in tension between the housing 200*a* and the telescoping rod 200*b* when the telescoping assembly 200 is in an extended state thereby biasing the telescoping assembly 200 toward the retracted state. Accordingly, when the telescoping assembly 200 is in the extended state as shown in FIG. 6A, and the user desires to move the foot section 47 to the location shown in FIG. 6B, the spring 222 applies an additional force that assists the user (once the locking device 202 is unlocked) by biasing the telescoping assembly 200 toward the retracted state shown in FIG. 6B. Other types of assist devices, such as gas springs, springs acting in compression, and the like, are also contemplated. For example, a spring may be acting in compression between the telescoping rod 200*b* and the housing 200*a* when in the extended state (and may be neutral or in compression in the retracted state). Such a spring (not shown) may be placed about the telescoping rod 200*b* between a spring seat and a shoulder formed at the end of the housing 200*a*.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a support structure comprising a base and a support frame;

a patient support deck supported by said support frame and comprising foot and leg sections arranged for movement relative to said support frame;

a first actuator configured to move said foot section relative to said support frame and a second actuator configured to move said leg section relative to said support frame, said leg section movable to one or more raised positions and said foot section coupled to said leg section to move with said leg section; and a support link having a first link end coupled to said foot section and a second link end slidably coupled to said support frame, wherein said first actuator is operable to move said support link in order to move said foot section relative to said leg section, wherein said first actuator is pivotally coupled to said foot section and pivotally coupled to said support link to pivotally interconnect said foot section and said support link.

2. The patient support apparatus of claim 1, wherein said patient support deck comprises a seat section.

3. The patient support apparatus of claim 2, wherein said seat section is fixed to said support frame.

4. The patient support apparatus of claim 1, wherein said foot section is pivotally coupled to said leg section and said support link is pivotally coupled to said foot section.

5. The patient support apparatus of claim 2, wherein said support frame comprises a guide, said second link end of said support link pivotally and slidably coupled to said guide.

6. The patient support apparatus of claim 5, wherein said first actuator is configured to slide said second link end of said support link away from said seat section to lower one end of said foot section relative to said leg section.

7. The patient support apparatus of claim 6, wherein said first actuator is configured to slide said second link end of said support link toward said seat section to raise said one end of said foot section relative to said leg section.

8. The patient support apparatus of claim 5, wherein said second link end of said support link is arranged to slide with respect to said guide when said second actuator raises or lowers said leg section.

9. The patient support apparatus of claim 5, wherein said first actuator has one actuator end pivotally coupled to said foot section and another actuator end pivotally coupled to said support link.

10. The patient support apparatus of claim 9, wherein said actuators are operable to move said patient support deck to different configurations.

11. The patient support apparatus of claim 10, wherein said configurations comprise a vascular configuration in which said leg section is raised relative to said support frame and said foot section is raised relative to said support frame, said first actuator configured to retract to raise said foot section for said vascular configuration.

12. The patient support apparatus of claim 10, comprising a controller in communication with said actuators to operate said actuators simultaneously or sequentially to move to said patient support deck to said different configurations.

13. The patient support apparatus of claim 5, wherein said support link comprises a pair of support arms and said guide defines a pair of slots, each of said support arms pivotally coupled to said foot section and pivotally and slidably coupled to said guide.

14. The patient support apparatus of claim 13, wherein said guide comprises a pair of guide tracks oriented parallel to a longitudinal axis of said support frame.

15. The patient support apparatus of claim 13, wherein said guide comprises a pair of guide tracks obliquely oriented relative to a longitudinal axis of said support frame.

16. The patient support apparatus of claim 13, wherein said slots have a shape that is at least one of linear or arcuate.

17. The patient support apparatus of claim 13, comprising at least one guided body mounted to said support arms for sliding relative to said guide, said at least one guided body captured in said guide.

18. The patient support apparatus of claim 17, wherein said at least one guided body comprises one of a block, a roller, a rod, or a gear.

19. The patient support apparatus of claim 17, wherein said guide comprises a pair of slide-bearing guide tracks and said at least one guided body comprises blocks slidable along said slide-bearing guide tracks.

20. A patient support apparatus comprising:

a support structure comprising a base and a support frame;

a patient support deck supported by said support frame and comprising first and second deck sections arranged for movement relative to said support frame;

a first actuator configured to move said first deck section and a second actuator configured to move said second deck section, said second deck section movable to one or more raised positions and said first deck section coupled to said second deck section to move with said second deck section; and a support link arranged to support said first deck section with respect to said support frame, said first actuator coupled to said support link and operable to move said support link in order to move said first deck section relative to said second deck section, wherein said first actuator is pivotally coupled to said first deck section and pivotally coupled to said support link to pivotally interconnect said first deck section and said support link.

21. A patient support apparatus comprising:

a support structure comprising a base and a support frame;

a patient support deck supported by said support frame and comprising foot and leg sections arranged for movement relative to said support frame;

an adjustment device configured to move said foot section relative to said support frame and an actuator configured to move said leg section relative to said support frame, said leg section movable to one or more raised positions and said foot section coupled to said leg section to move with said leg section; and a support link having a first link end coupled to said foot section and a second link end slidably coupled to said support frame, wherein said adjustment device is operatively coupled to said support link to control movement of said foot section relative to said leg section, wherein said adjustment device is pivotally coupled to said foot section and pivotally coupled to said support link to pivotally interconnect said foot section and said support link.

22. The patient support apparatus of claim 21, wherein said adjustment device comprises a telescoping assembly adjustable between retracted and extended states, a locking device configured to lock said telescoping assembly in one of said retracted and extended states, and a release device configured to be manually actuated to unlock said locking device.

23. The patient support apparatus of claim 22, comprising an assist device configured to bias said telescoping assembly toward said retracted state.

* * * * *